US005522296A

United States Patent [19]

Stoller

[11] Patent Number: 5,522,296

[45] Date of Patent: Jun. 4, 1996

[54] COVE BASE CUTTER GUIDE

[76] Inventor: Bruce Stoller, 22614 - 15th Ave. SE., Kent, Wash. 98031

[21] Appl. No.: 273,733

[22] Filed: Jul. 12, 1994

[51] Int. Cl.[6] ..... B27G 5/02

[52] U.S. Cl. ..... 83/762; 83/581; 83/820; 269/288; 269/295

[58] Field of Search ..... 144/216, 217; 83/581, 761, 762, 820; 30/286, 289, 290; 269/286, 287, 290, 292, 293, 295

[56] References Cited

U.S. PATENT DOCUMENTS

| | | | |
|---|---|---|---|
| 592,139 | 10/1897 | Griffith | 83/761 |
| 1,718,791 | 6/1929 | Ludwig | 83/762 |
| 3,782,235 | 1/1974 | Curcio | 83/762 |
| 3,811,356 | 5/1974 | Wyler | 83/762 |
| 3,837,253 | 9/1974 | Slemmons | 83/762 |
| 4,095,500 | 6/1978 | Rouse | 83/762 |
| 4,436,014 | 3/1984 | O'Neill | 83/762 |

*Primary Examiner*—W. Donald Bray
*Attorney, Agent, or Firm*—David L. Tingey

[57] ABSTRACT

A cove base cutting guide provides a stable guide for holding a cove of soft material, such as rubber or synthetic rubber, achieved in a bottom, top, ends and front and back sides with a cove-shaped chamber within, the integrity of the guide breached only by fully-contained slits on the front side within the front side and by a narrow opening the size and shape of a cove base in the ends for receiving and discharging a cove end piece cut from cove stock in the guide. To maintain the knife in alignment within the slit, the guide includes a chamber groove opposite each slit into which the end of the knife passes. The front slitted side is thin such that a conventional utility knife of length typically only about 1-inch reaches from the front side through the chamber into the guide grooves. In an alternative embodiment, a stabilizing block is attached to the guide back side to maintain guide structural stability when the chamber grooves are extended as slits through the guide back side and stabilizing block.

4 Claims, 3 Drawing Sheets

COVE BASE CUTTER GUIDE

FIELD OF THE INVENTION

This invention relates generally to an improved guide for cutting a cove base.

BACKGROUND OF THE INVENTION

It is common to use a cove base at the bottom of a wall so as to eliminate the usual interior angle between a wall and a floor. In installation of a cove base, it is necessary to end abutt cove base ends and to route a cove base around corners, both interior and exterior. It is desireable to minimize the noticeability of the cove base joint in doing so, and so the adjoining cove bases are cut with matching angles, each typically cut at an angle equal to half of the angle of junction.

When a cove base is made of a stiff material, such as wood, metal, or hard plastic, it is satisfactory to use a miter box as a guide in cutting the junction angles. However, when the material is soft such as rubber or synthetic rubber, the cove base does not maintain its shape when being cut. The result is a cut that is not consistent or straight, and does not match with a cut on an adjoining cove base. Thus, the cove base joint is easily noticeable and less attractive. Because such joints are not attractive, soft material cove bases are often bent into and around corners, resulting in cove bases not matching the sharp contour of the corner and also appearing less than aethestically pleasing.

What is needed is a cutting guide shaped to match the shape of a cove base so the cove base is held firmly while it is being cut. The guide should also be stable against distortion during the cutting. It is common in the prior art to have various forms of cutting guides, but none of them are shaped to hold a cove base firmly in place. Previous guides typically also have matching opposing slits with a receiving area between them into which a material to be cut is placed. Each set of opposing slits are generally provided in a wall and extend to the wall top so that a knife or saw passes through the top of the guide and down the slit. This design defines upwarding extending fingers separated and secured only at the guide bottom, potentially resulting in an unstable slit guide, especially for soft materials. The problem remains to have a stable cutting guide for soft materials that produces matching angle cuts so that joints of cut materials are scarcely noticeable.

SUMMARY OF THE INVENTION

The object of the present invention is to provide a cove base cutting guide that is stable in holding a cove base of soft material, such as rubber or synthetic rubber, in a cove-shaped chamber while it is cut by a conventional utility knife having a blade only about 1-inch in length. To ensure the shape integrity of the chamber, rigidity is obtained with an immovable top rigidly integrated in the housing to similarly immovable front, back and end sides including the slitted side.

A utility knife accesses the chamber through one of a plurality of slits intermediate a thin front wall of perhaps ⅛-inch thickness with the slits terminating on a cove-shaped cavity. That is, the front-wall slits do not pass out of the top or bottom of the wall. For stability of the thin-walled guide, the guide slits pass only through the front side, leaving the opposing back side unbreached, allowing the back side to be constructed of relatively thin material similar to the front while structurally preventing the housing from leaning into a nonright position.

The cove-shaped cavity is defined on its front side by the slitted wall and on its back side by the thin solid wall. The top and bottom of the guide integrated with the walls closes the chamber. One guide end wall is open to the chamber to receive a cove base into the chamber. The cove base end piece cut from the cove base stock exits the chamber through the other guide end wall.

To maintain the knife in alignment within the slit, the guide includes a groove within the chamber corresponding to opposite each slit into which the end of the knife passes. Aligned groove and slit combinations are provided for knife orientation in the guide typically at 90°, +45°, and −45° to the chamber longitudinally and hence a cove base in the chamber. It is also inherent that with the knife not extending out of the back side, safety against inadvertent user cuts is enhanced.

Thus, the guide presents a thin but rigid housing around an enclosed chamber in which a cove base is held while a knife passes through a slit in one side and into the chamber, cutting the cove base therein as the knife moves down the slit.

In an alternative embodiment, stability can be achieved in a stabilizing block affixed to the back side to prevent the guide from leaning even with a plurality of slits passing therethrough. It is clear that the housing may be constructed with a thickness on the back side equivalent to adding a stabilizing block without detracting from the essence of the invention. In this alternative embodiment then, the integrated back and block may also comprise slits corresponding to and in alignment with the front slits in lieu of chamber grooves thereby allowing a cutting instrument longer than a well-known utility knife with a blade length of about 1-inch to pass entirely through the guide.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

DESCRIPTION OF THE PREFERRED EMBODIMENT

Figure 2:
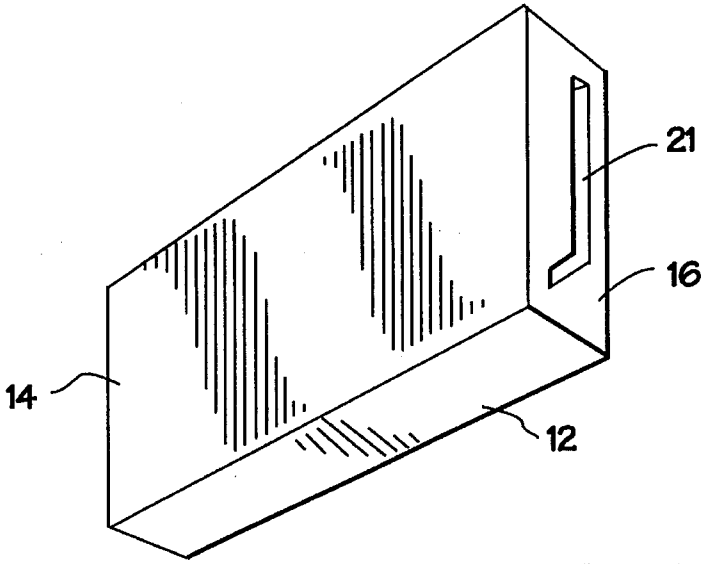
FIG. 2 is a bottom and back perspective view of the invention.
Figure 4:
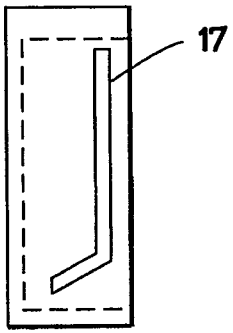
FIG. 4 is an end view of the invention.
Figure 1:
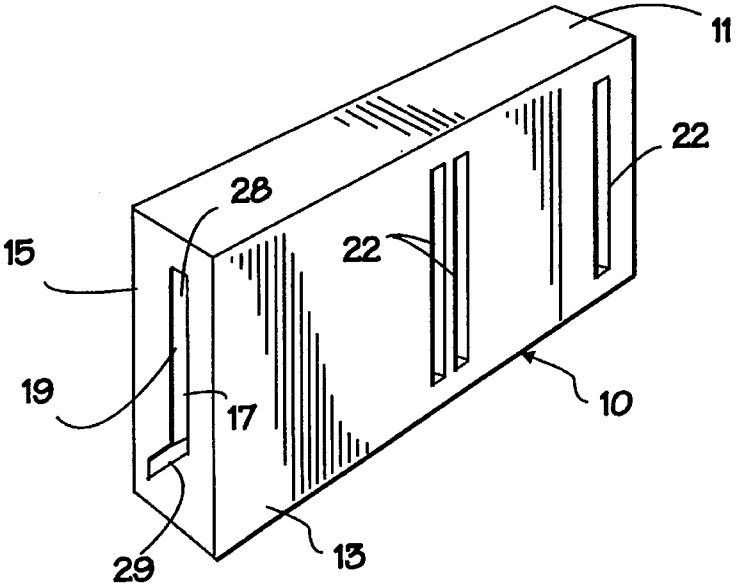
FIG. 1 is a top and front perspective view of the cove base cutter guide.
Figure 3:
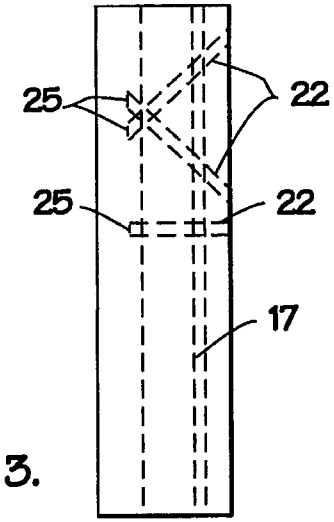
FIG. 3 is a top view of the invention.
Figure 7:
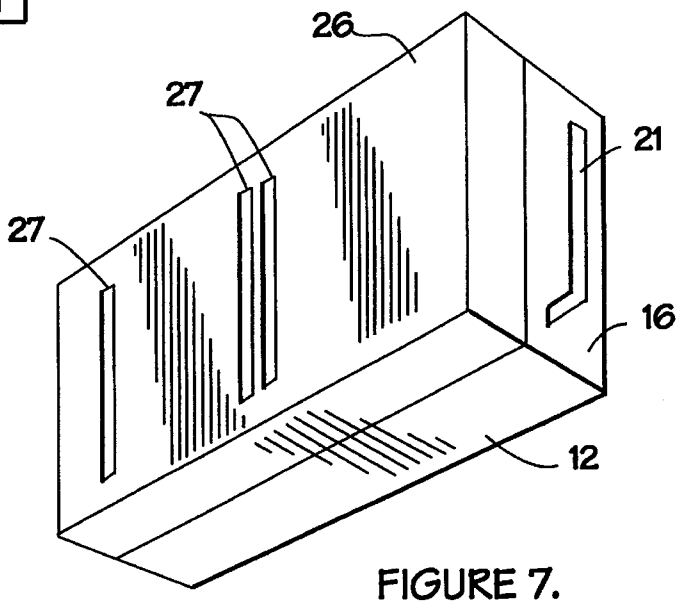
FIG. 7 is a bottom and back perspective view of the alternative embodiment of the invention.
Figure 8:
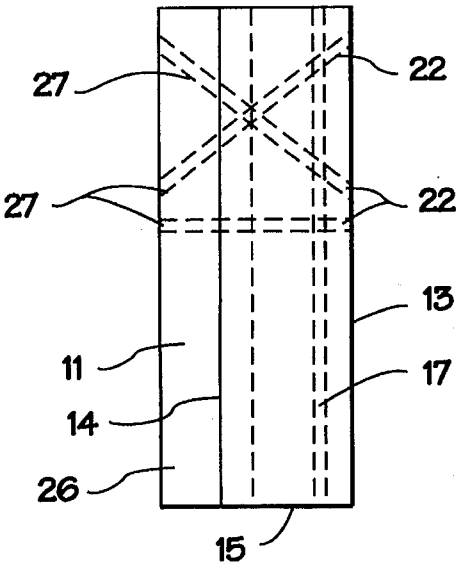
FIG. 8 is a top view of the alternative embodiment of the alternative embodiment of the invention.
Figure 5:
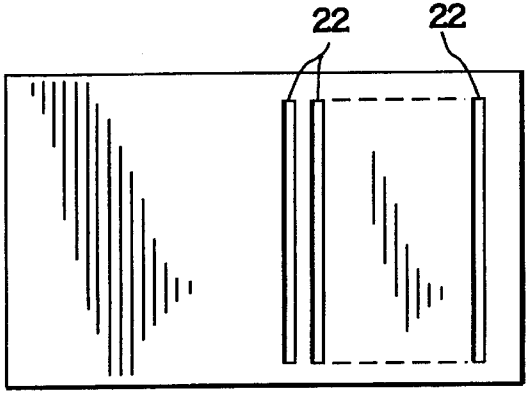
FIG. 5 is a front view of the invention.
Figure 6:
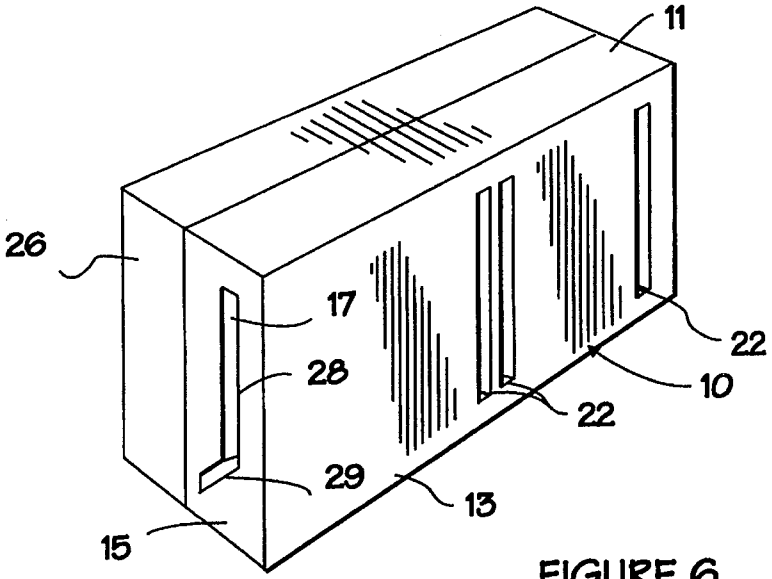
FIG. 6 is a top and front perspective view of an alternative embodiment of the cove base cutter guide.
Figure 10:
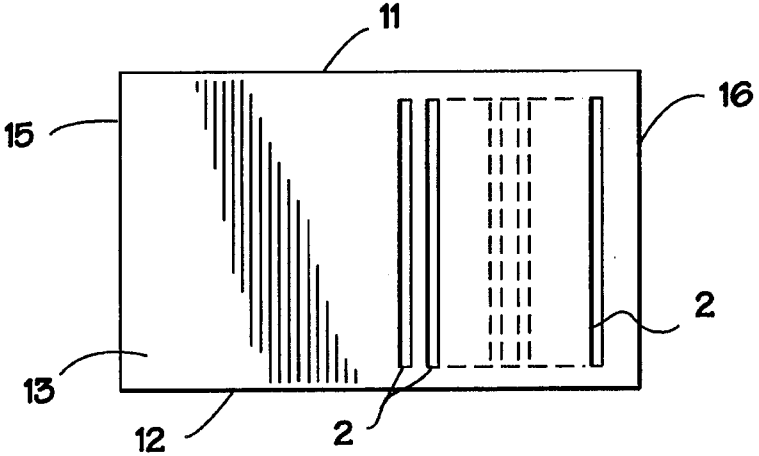
FIG. 10 is a front view of the alternative embodiment of the invention.
Figure 11:
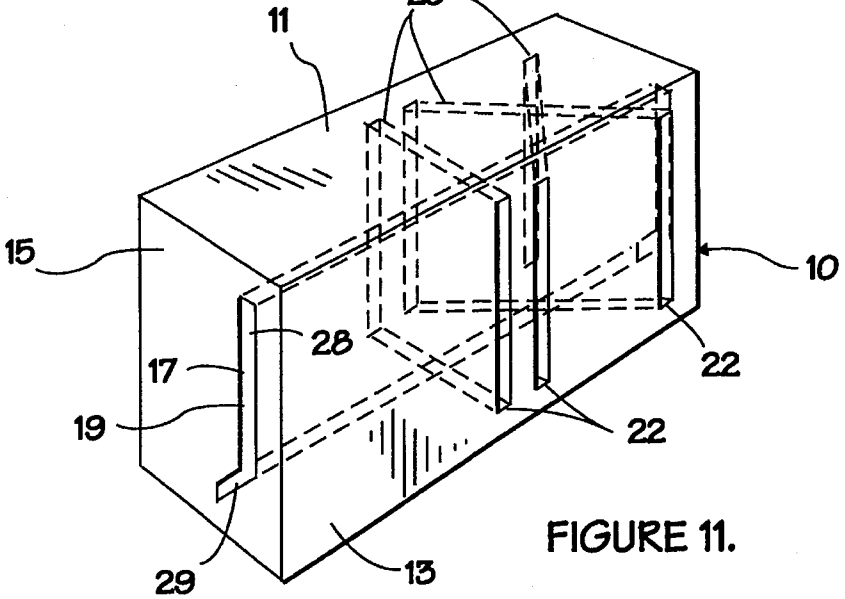
FIG. 11 is front perspective view of the cove base cutter showing internal slits, channels and chamber.
Figure 9:
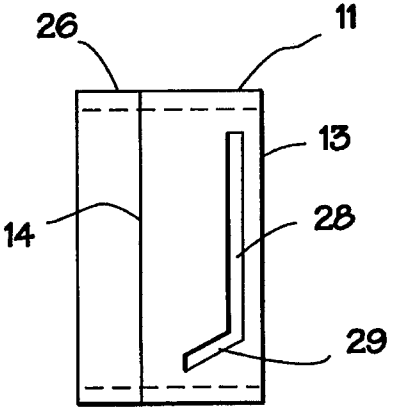
FIG. 9 is an end view of the alternative embodiment of the invention.

Referring to the figures, the cove base cutter guide 10 of the present invention comprises a top side 11, a bottom side 12, a front side 13, a back side 14 opposing the front side, an entry end side 15, and an exit end side 16 opposing the entry end 15, all sides mutually affixed to form the integral guide. The guide 10 further includes an enclosed chamber 17 within shaped to match that of a cove base, in the general shape of a "J" to support the cove base in the chamber 17 without allowing the cove base to distort its shape as it is cut.

The chamber 17 is further sized to hold the cove base with a mild frictional fit to further preclude movement in the chamber 17 while it is being cut. Access to the chamber 17 is through an entry port 19 in the entry end 15. Discharge from the chamber 17 of end cut cove base pieces is through an exit port 21 on the exit end 16.

The front side 13 only comprises one or more slits 22 passing through the side into the chamber 17 at a selective angle Typically, slits are provided at angles 90°, +45°, and −45° to the chamber 17 such that a cove base in the chamber 17 will be cut at the given angle by a knife in the slit 22. Because it is normal that a knife with a blade only about 1 inch in length (commonly known as a utility knife) be used instead of a saw, the front side 13 has a depth to the chamber of about ⅛-inch.

The chamber 17 further includes one or more grooves 25 opposite the slits 22, respectively, in the guide back side 14 to receive the end of the knife passed through a slit 22 and the chamber 17, the end of which passes into a corresponding groove 25 to guide the knife as it moves down the chamber 17 through a cove base.

In an alternative embodiment, a stabilizing block 26 is affixed to the back side 14 such that the integrated back side and stabilizing block do not distort in shape during use even with slits passing therethrough, and therefore further comprising in the integrated back side and stabilizing block one or more slits 27 in lieu of the chamber grooves 25; that is, the grooves 25 extend through the back side 14 to become slits 27, which back side is thick in the manner of a block.

The "J" shape of the guide chamber, defined approximately as a straight back portion 28 and a foot portion 29 communicating obtusely with the back portion 28 in the shape of a cove base, is aligned with the chamber back portion 28 approximately parallel with the guide front side 13 and the foot portion 29 extending away from the back portion 29 a distance no greater than a remaining length of a utility knife blade after it extends through a front side slit.

Having described the invention, what is claimed is:

1. A cove base cutter guide comprising a guide with an enclosed chamber including an intact one-piece top side, an intact one-piece bottom side, a front side, a one-piece back side between back inner and outer surfaces opposing the front side, an entry end, and an, exit end opposing the entry end around the chamber, all sides mutually affixed immovably to form an integral guide with a thin chamber enclosed within, the enclosed chamber shaped to match that of a cove base for supporting the cove base in the chamber without allowing the cove base to distort its shape as it is cut and having an entry port in the entry end and a discharge port; at the exit end providing access to the chamber, the front side further having one or more slits passing through the front side at a selective angle and terminating in the chamber, the front side and chamber together being less than 1-inch thin such that a conventional short blade utility knife having a blade only about 1-inch in length can extend through a slit in the front side and fully across the thin chamber at all positions of the knife in the slit, the back side further having one or more grooves in its inner side opposite the slits, respectively, to receive the end of a knife passing through a slit and the chamber, the end of which passes into a corresponding groove to guide the knife in the selective slit angle as it moves down the chamber, the groove or grooves terminating within the back side such that the back outer surface remains intact along with the top and bottom sides, thus maintaining their integrity and enhanced stability of the guide.

2. A cove base cutter guide comprising a guide with an enclosed chamber including an intact one-piece top side, an intact one-piece bottom side, a front side, a one-piece back side between back inner and outer surfaces opposing the front side, an entry end, and an exit end opposing the entry end around the chamber, all sides mutually affixed immovably to form an integral guide with a thin chamber enclosed within, the enclosed chamber shaped to match that of a cove base for supporting the cove base in the chamber without allowing the cove base to distort its shape as it is cut and having an entry port in the entry end and a discharge port at the exit end providing access to the chamber, the front side further having one or more front side slits passing through the front side at a selective angle and terminating in the chamber, the front side and chamber together being less than 1-inch thin such that a conventional short blade utility knife having a blade only about 1-inch in length can extend through a front side slit and fully across the thin chamber at all positions of the knife in the slit the back side further having one or more back side slits opposite the front side slits, respectively, to receive the end of a knife passing through a front side slit and the chamber, the end of which passes into a corresponding back side slit to guide the knife in the selective slit angle as it moves down the chamber, a stabilizing block affixed to the back side so that the guide does not distort in shape with slits passing therethrough and having one or more slits passing through the affixed back side and stabilizing block aligned with and corresponding to the front side slits, respectively, to receive the end of a knife passed through the chamber to guide the knife as it moves down the chamber through a cove base.

3. The cove base cutter guide of claim 1 in which the chamber is sized to provide a mild friction fit with a cove base to hold the cove base in place undistorted in shape in the chamber while being cut.

4. The cove base cutter guide of claim 1 in which the chamber is shaped with an approximately straight back portion and a foot portion communicating obtusely with the back portion in the shape of a cove base, the chamber back portion aligned approximately parallel with the guide front side and the foot portion extending away from the back portion.

* * * * *